US008147157B2

(12) United States Patent
Kawashima et al.

(10) Patent No.: US 8,147,157 B2
(45) Date of Patent: Apr. 3, 2012

(54) RECORDING APPARATUS

(75) Inventors: Hideki Kawashima, Yokohama (JP); Kenji Ito, Yokohama (JP); Hitoshi Nishitani, Ohta-ku (JP); Gen Kitamura, Kawasaki (JP)

(73) Assignee: Canon Kabishiki Kaisha, Tokyo (JP)

( * ) Notice: Subject to any disclaimer, the term of this patent is extended or adjusted under 35 U.S.C. 154(b) by 605 days.

(21) Appl. No.: 11/462,677

(22) Filed: Aug. 4, 2006

(65) Prior Publication Data

US 2007/0031172 A1 Feb. 8, 2007

(30) Foreign Application Priority Data

Aug. 8, 2005 (JP) ..... 2005-229769

(51) Int. Cl.
*B41J 11/58* (2006.01)
*B41J 13/10* (2006.01)

(52) U.S. Cl. ..... 400/624; 400/625; 400/208; 347/108

(58) Field of Classification Search ..... 400/207, 400/208, 120.7–120.8, 242, 578, 624, 625; 347/104; 271/226
See application file for complete search history.

(56) References Cited

U.S. PATENT DOCUMENTS

| | | | | |
|---|---|---|---|---|
| 5,305,020 A * | 4/1994 | Gibbons et al. | ..... | 347/177 |
| 6,069,642 A | 5/2000 | Isobe | | |
| 6,504,563 B2 * | 1/2003 | Kanai | ..... | 347/209 |
| 6,848,848 B2 * | 2/2005 | Terao | ..... | 400/624 |
| 6,997,458 B1 * | 2/2006 | Yokomi | ..... | 273/288 |
| 7,242,417 B2 * | 7/2007 | Nishitani et al. | ..... | 347/218 |

FOREIGN PATENT DOCUMENTS

| | | | |
|---|---|---|---|
| EP | 0473132 | | 3/1992 |
| EP | 1580013 | | 9/2005 |
| EP | 1652681 | | 5/2006 |
| JP | 60-192655 | A | 10/1985 |
| JP | 2-132040 | A | 5/1990 |
| JP | 04-110172 | A | 4/1992 |
| JP | 5-213487 | | 8/1993 |
| JP | 05-213487 | * | 8/1993 |
| JP | 07-125858 | | 5/1995 |
| JP | 2523355 | | 8/1996 |
| JP | 2000-108442 | | 4/2000 |
| JP | 3096060 | U | 8/2003 |

* cited by examiner

*Primary Examiner* — Leslie J Evanisko
*Assistant Examiner* — Marissa Ferguson Samreth
(74) *Attorney, Agent, or Firm* — Canon USA, Inc., I.P. Division

(57) ABSTRACT

A cartridge, detachably attached to a recording apparatus, includes a recording sheet container. The recording apparatus includes a sheet turning device. When a recording sheet is conveyed from the cartridge to an image forming section, the sheet turning device turns the recording sheet around an axis parallel to a normal line to the recording surface of the recording sheet. The longitudinal direction of the recording sheets contained in the recording sheet container is generally perpendicular to the longitudinal direction of the recording sheet being subjected to recording in the image forming section.

18 Claims, 7 Drawing Sheets

RECORDING APPARATUS

BACKGROUND OF THE INVENTION

1. Field of the Invention

The present invention relates to a recording apparatus that forms an image on a recording sheet on the basis of image information.

2. Description of the Related Art

A recording apparatus is used as an output device for a computer or an output device for a digital image. In addition, a recording apparatus is also used for a photocopier, a scanner, a complex machine of these, or a system. The recording apparatuses can be classified according to recording method into categories, for example, a thermal transfer type, an ink jet type, a laser beam type, and a wire dot type. In addition, the recording apparatuses can also be classified into either a serial type or a line type. The serial type uses both the main scanning by a recording head and the sub-scanning by paper feeding. The line type uses a line recording head and performs recording using only the sub-scanning. In a thermal transfer recording apparatus, an ink sheet is pressed against a recording sheet and heated so as to transfer ink, and image recording is thereby performed. Particularly in a line type thermal transfer recording apparatus, a plurality of heating elements arranged in the width direction of a recording sheet are selectively driven, the recording sheet and an ink sheet are conveyed in the sub-scanning direction, and dot-line-like images are thereby sequentially recorded.

Recently, with the advancement of image input devices such as a digital camera, a digital camcorder, and a scanner, a thermal transfer recording apparatus has gotten a lot of attention. A thermal transfer recording apparatus is a recording apparatus suitable for printing out electronic image information picked up with a still camera or a camcorder, through a computer or a memory medium. In other types of recording apparatuses such as an ink jet recording apparatus, there is only a binary choice between to form a dot or not. Therefore, small dots are formed on a recording sheet and for example, error diffusion is used so as to obtain apparent resolution and gradation.

In contrast, in the case of a thermal transfer recording apparatus, the value of heat that can control a pixel can be easily changed. Therefore, a pixel can have a wide range of gradation. Therefore, compared to other recording apparatuses such as an ink jet recording apparatus, a thermal transfer recording apparatus has the advantage that a smooth and high-quality image can be obtained. In addition, in a thermal transfer recording apparatus, since the performance of a thermal head as a recording unit and the performance of recording sheet material have been improved, a print image even equal to a silver salt photograph in quality can be obtained. In step with the recent advancement of digital cameras, a thermal transfer recording apparatus has gotten a lot of attention, particularly as a recording apparatus for a natural image.

In addition, there has arrived a system such that a thermal transfer recording apparatus is directly connected to an image pickup device, such as a digital camera or a digital camcorder, with a cable, and performs printing out without using a device that processes image information, such as a computer. Moreover, there has arrived a system such that an image pickup device, such as a digital camera or a digital camcorder, with integral thermal transfer recording apparatus, directly prints out the photographed information without using a device that processes image information, such as a computer. These systems make it possible to print out the image information from a digital camera or a digital camcorder, easily and photographically. Therefore, a thermal transfer recording apparatus has increasingly gotten a lot of attention. However, in a thermal transfer recording apparatus, in order to perform full color printing, it is necessary to transfer a plurality of colors of inks, repeatedly and one over the other. A general configuration to realize this will hereinafter be described.

FIGS. 4A and 4B are sectional views of a first example of a conventional thermal transfer recording apparatus. FIG. 4A shows a state in which recording is being performed on a recording sheet P. FIG. 4B shows a state in which the recording sheet P has been moved to the starting position for recording in the next color. In FIGS. 4A and 4B, recording sheets P are contained in a cassette 101. Only the top sheet is separated and fed by a paper feeding roller 102 and a separating unit 103. The recording sheet P is conveyed to the nip between a recording head (thermal head) 104 and a platen roller 105. The circumference of the platen roller 105 is slightly longer than the full length of the recording sheet P. The recording sheet P is wound around the platen roller 105. As shown in FIG. 4A, an ink sheet 106 pulled out from a cartridge 110 and the wound recording sheet P are pressed against each other by the recording head 104 and the platen roller 105. The recording head 104 generates heat to transfer the ink on the ink sheet 106 onto the recording sheet P, and the platen roller 105 is rotated, thereby performing image recording (printing).

After the printing in a first color is completed in the state shown in FIG. 4A, the recording head 104 releases the ink sheet 106 from the recording sheet P. The platen roller 105 is then further rotated so as to locate the recording sheet P at the print starting position shown in FIG. 4B. Next, printing in a second color is performed in the same manner as the first color. If necessary, printing is repeatedly performed in third, fourth . . . colors in the same manner. In this way, by printing in three colors: yellow, magenta, and cyan, a full color printing can be performed.

FIGS. 5A and 5B are sectional views of a second example of a conventional thermal transfer recording apparatus. FIG. 5A shows a state in which recording is being performed on a recording sheet P. FIG. 5B shows a state in which the recording sheet P is being moved to the starting position for recording in the next color. In FIGS. 5A and 5B, recording sheets P are contained in a cassette 201. Only the top sheet is separated and fed by a paper feeding roller 202 and a separating unit 203. The recording sheet P is conveyed to the nip between a recording head (thermal head) 204 and a platen roller 205. As shown in FIG. 5A, an ink sheet 206 pulled out from the cartridge 210 and the conveyed recording sheet P are pressed against each other by the recording head 204 and the platen roller 205. The recording head 204 generates heat to transfer the ink on the ink sheet 206 onto the recording sheet P, thereby performing image recording (printing). A pair of rollers consisting of a capstan roller 209 and a pinch roller 208 is disposed on the downstream side of the recording (transferring) section. When the recording operation is performed, the recording sheet P is conveyed by these rollers.

After the printing in a first color is completed in the state shown in FIG. 5A, the recording head 204 releases the ink sheet 206 from the recording sheet P. As shown in FIG. 5B, the capstan roller 209 and the pinch roller 208 are rotated in the opposite direction from that during the printing operation so as to return the recording sheet P to the starting position. Next, printing in a second color is performed in the same manner as the first color. If necessary, printing is repeatedly performed in third, fourth . . . colors in the same manner. In this way, by printing in three colors: yellow, magenta, and cyan, a full color printing can be performed.

The recording sheets P in the cassette 101 and the ink sheet 106 in the cartridge 110 in FIGS. 4A and 4B, and the recording sheets P in the cassette 201 and the ink sheet 206 in the cartridge 210 in FIGS. 5A and 5B are consumables and need to be replaced or supplied. In general, the ink sheet 106 or 206 is supplied to users in the form of a cartridge 110 or 210 such that both ends of the ink sheet are wound on two bobbins, and the two bobbins and the ink sheet are contained in a frame 107 or 207. In FIGS. 4A, 4B, 5A, and 5B, the frames 107 and 207 are frames of the cartridges 110 and 210, respectively.

The frames 107 and 207 of the cartridges 110 and 210 have recesses 110*a* and 210*a*, respectively. When the cartridge 110 or 210 is attached to a recording apparatus, as shown, the recording head (thermal head) 104 or 204 in the apparatus body is located in the recess 110*a* or 210*a*. At this time, the cartridge is guided by the recording head to a predetermined position.

The first example of FIGS. 4A and 4B has the following disadvantages. Since a platen roller having a circumference slightly longer than the full length of the recording sheet P is necessary, the size of the apparatus is increased. In addition, since a mechanism that winds and holds the recording sheet P around the platen roller is necessary, the apparatus is complicated. However, the first example has the following advantage. The starting position of printing in the second color is just behind the ending position of printing in the first color. Therefore, the recording sheet P need not be returned as in the second example of FIGS. 5A and 5B. Therefore, the speed of recording operation is high. On the other hand, the second example of FIGS. 5A and 5B has the disadvantage that it takes a long time to print, but has the advantage that the apparatus is compact and simple.

In a thermal transfer recording apparatus, in order to obtain high quality print, it is necessary to use special paper having a surface onto which ink is easily transferred. Therefore, for example, a cartridge containing an ink sheet for printing 50 recording sheets, and 50 recording sheets are sold by the set. When a user uses the recording sheets and the cartridge sold by the set, first, the user unpacks them, then attaches the cartridge in the apparatus body, and places the recording sheets in the cassette. It is troublesome to place the recording sheets and the cartridge in different places.

FIGS. 6A and 6B each schematically show an example of a set with a cartridge and recording sheets. FIG. 6A shows an A6 size recording sheet and an ink cartridge for A6 size. FIG. 6B shows an A7 size recording sheet and an ink cartridge for A7 size. In the case of a thermal transfer recording apparatus, in order to reduce the waste of the ink sheet, it is necessary to prepare different ink sheets according to the size of recording sheet. Therefore, as shown in FIGS. 6A and 6B, for example, A6 size recording sheets and a cartridge containing an ink sheet for A6 size recording sheets are sold by the set, and A7 size recording sheets and a cartridge containing an ink sheet for A7 size recording sheets are sold by the set. Users buy the sets according to their purposes. When the printing of A7 size recording sheets is performed after the printing of A6 size recording sheets is performed, a user needs to take out the A6 size recording sheets and the cartridge for A6 size recording sheets and then, instead of them, to load the A7 size recording sheets and the cartridge for A7 size recording sheets.

The unloaded A6 size recording sheets and cartridge for A6 size recording sheets need to be kept for future use. However, the cartridge and the recording sheets are separated. In addition, since the cartridge and the recording sheets must not be subjected to dust and direct sunlight, they need to be kept in, for example, bags. Therefore, it is troublesome to handling them. To eliminate such troublesomeness, an integrated cartridge containing both an ink sheet and recording sheets is proposed in Japanese Patent No. 2523355 and Japanese Patent Laid-Open No. 2000-108442 (corresponding to U.S. Pat. No. 6,069,642).

In the transfer paper cartridge disclosed in Japanese Patent No. 2523355, an ink sheet container and a recording sheet container are integrated. However, printing cannot be performed with the ink sheet contained in the cartridge. Therefore, when printing is performed, it is necessary to take out the ink sheet from the cartridge and to load the ink sheet to the printing position. The mechanism therefore complicates the apparatus, and it is difficult to maintain reliability.

The Japanese Patent Laid-Open No. 2000-108442 solves the problem of Japanese Patent No. 2523355 and discloses an integrated cartridge (integrated cassette) such that it is not necessary to load an ink sheet to the printing position after the cartridge is loaded in an apparatus, and printing can be performed with the ink sheet contained in the cartridge. The configuration of Japanese Patent Laid-Open No. 2000-108442 can eliminate the trouble to separately place an ink sheet and recording sheets. In addition, the configuration of Japanese Patent Laid-Open No. 2000-108442 can provide a highly usable printer such that when different types of recording sheets are used, there is no trouble to separately keep the unloaded ink sheet and recording sheets.

However, the recording apparatuses of Japanese Patent No. 2523355 and Japanese Patent Laid-Open No. 2000-108442 have problems to be solved in terms of the installation area and the height of the apparatus. FIGS. 7A, 7B, 8A, and 8B are plan views and longitudinal sectional views showing the definitions of the installation area and the height of the recording apparatus. FIGS. 7A and 7B show a recording apparatus configured to convey recording sheets contained in an integrated cartridge attached to an apparatus body, in their longitudinal direction (in a direction parallel to the long side). FIG. 7A is a plan view. FIG. 7B is a sectional view taken along line VIIB-VIIB of FIG. 7A. In FIGS. 7A and 7B, a cartridge having a recording sheet container 2 and an ink sheet container 3 is attached to a cartridge mounting portion of a frame 1 of a recording apparatus. In addition, FIGS. 7A and 7B show recording sheets loaded in the cartridge (recording sheet container 2) and a recording sheet sent out from the cartridge for printing. The installation area 6 of the recording apparatus is the projected area of the recording apparatus body onto a plane parallel to the recording sheets 5. The height 9 of the recording apparatus is the size of the recording apparatus body in the direction perpendicular to a plane parallel to the recording sheets 5.

However, the conventional recording apparatuses have problems to be solved when they are designed such that the installation area is minimized. The problems will be described with reference to FIGS. 7A and 7B. In FIG. 7A, reference letter D denotes the longitudinal direction of the recording sheets 5*a* contained in the integrated cartridge 10 attached to the body, and reference letter E denotes the longitudinal direction of the recording sheet 5*b* being subjected to recording in the image transferring section 20. The recording apparatus is configured such that the longitudinal direction D is parallel to the longitudinal direction E. The longitudinal direction of the recording sheet discharged after the recording is also the same as (parallel to) the direction E during the recording. Such configuration is inevitable because the printing operation is performed by straight conveying one of the recording sheets contained in the cartridge 10 with a roller to the image transferring section 20.

In FIG. 7A, the area surrounded by the dashed line 6 designates the installation area of the recording apparatus. In this installation area and on both sides of the integrated cartridge 10, areas 16 are provided. These areas 16 are used for disposing "parts that cannot be disposed in an area Z through which a recording sheet passes during the printing, in terms of design" or "parts that can be but should not be disposed in the area Z." The "parts that cannot be disposed in terms of design" include mechanical parts such as a gear driving a roller and stationary parts such as a shaft bearing. Since these parts transmit driving force to conveyance rollers so as not to interfere with the recording sheet being conveyed, these parts cannot be disposed in the area Z through which a recording sheet passes.

The "parts that should not be disposed" include electrical parts such as a motor, a power source board, and a control board. These parts include many large parts such as a motor case and an electrolytic capacitor. If these parts are disposed in the area Z through which a recording sheet passes, the height of the apparatus body increases. Therefore, these parts should not be disposed in the area Z. In addition, lines that must not be subjected to electrical noise, for example, signal lines to the recording head, should be as short as possible to ensure stable operation. Therefore, lines of, for example, a control board are generally disposed on both sides of the board to minimize their length. For these reasons, spaces (areas) 16 for disposing the above-described parts are provided on both sides of the integrated cartridge 10.

The installation area 6 of the recording apparatus is the sum of the areas of the recording sheet container 2 and the spaces 16. The size of the apparatus body increases with an increase in the size of the recording sheet. This is the same regardless of the direction of the recording sheet. FIGS. 8A and 8B show a recording apparatus configured to convey recording sheets contained in an integrated cartridge attached to an apparatus body, in their width direction (in a direction parallel to the short side). FIG. 8A is a plan view. FIG. 8B is a sectional view taken along line VIIIB-VIIIB of FIG. 8A. That is to say, FIGS. 8A and 8B show a recording apparatus in which recording sheets are conveyed in the portrait position in contrast to the landscape position in the recording apparatus of FIGS. 7A and 7B. In FIGS. 8A and 8B, the same reference numerals are used to designate the components corresponding to those in FIGS. 7A and 7B. As is clear from FIGS. 7A, 7B, 8A, and 8B, the installation area 6 of the recording apparatus is the sum of the areas of the recording sheet container 2 and the spaces 16. Therefore, regardless of whether the recording sheets are in the landscape position or the portrait position when they are subjected to printing and are in the container, the installation area 6 of the recording apparatus cannot be reduced.

For the conventional recording apparatus that uses an integrated cartridge, the installation area of the apparatus depends largely on the size of the recording sheet. In addition, spaces for disposing "parts that cannot be disposed in an area Z through which a recording sheet passes during the printing, in terms of design" or "parts that can be but should not be disposed in the area Z" are necessary. Therefore, although the conventional recording apparatuses shown in FIGS. 7A, 7B, 8A, and 8B can provide high usability by using an integrated cartridge, it is very difficult to reduce the installation area 6 of the recording apparatus, and reduction in size and weight is limited.

SUMMARY OF THE INVENTION

The present invention is directed to a recording apparatus to which an integrated cartridge containing recording sheets and an ink sheet can be attached, without increasing the installation area of the apparatus body. In addition, the present invention is directed to a recording apparatus such that the installation area of the apparatus body is close to the area of the recording sheet container.

In an aspect of the present invention, a recording apparatus includes a detachable cartridge having a recording sheet container adapted to contain recording sheets. The apparatus includes a recording head configured to record an image on a recording sheet fed from the cartridge to an image forming section. The apparatus further includes a sheet turning device. When a recording sheet is conveyed from the cartridge to the image forming section, the sheet turning device turns the recording sheet around an axis parallel to a normal line to the recording surface of the recording sheet. A longitudinal direction of the recording sheets contained in the recording sheet container is generally perpendicular to a longitudinal direction of the recording sheet being subjected to recording in the image forming section.

Further features of the present invention will become apparent from the following description of exemplary embodiments (with reference to the attached drawings).

BRIEF DESCRIPTION OF THE DRAWINGS

FIG. 1A is a plan view. FIG. 1B is a sectional view taken along line IB-IB of FIG. 1A. FIG. 1C is a sectional view taken along line IC-IC of FIG. 1A.

FIG. 2A shows the state in which one of the recording sheets in the cartridge is separated and fed. FIG. 2B shows the state in which the fed recording sheet is turned. FIG. 2C shows the state in which the turned recording sheet is conveyed to the image forming section. In each of FIGS. 2A to 2C, the upper figure is a plan view, and the lower figure is a sectional view.

FIG. 3A shows the state in which one of the recording sheets in the cartridge is separated and fed. FIG. 3B shows the state in which the fed recording sheet is turned. FIG. 3C shows the state in which the turned recording sheet is conveyed to the image forming section. In each of FIGS. 3A to 3C, the upper figure is a plan view, and the lower figure is a sectional view.

FIG. 4A shows a state in which recording is being performed on a recording sheet P. FIG. 4B shows a state in which the recording sheet P has been moved to the starting position for recording in the next color.

FIG. 5A shows a state in which recording is being performed on a recording sheet P. FIG. 5B shows a state in which the recording sheet P is being moved to the starting position for recording in the next color.

FIG. 6A shows an A6 size recording sheet and an ink cartridge for A6 size. FIG. 6B shows an A7 size recording sheet and an ink cartridge for A7 size.

FIG. 7A is a plan view. FIG. 7B is a sectional view taken along line VIIB-VIIB of FIG. 7A.

FIG. 8A is a plan view. FIG. 8B is a sectional view taken along line VIIIB-VIIIB of FIG. 8A.

DESCRIPTION OF THE EMBODIMENTS

Figure 1A:
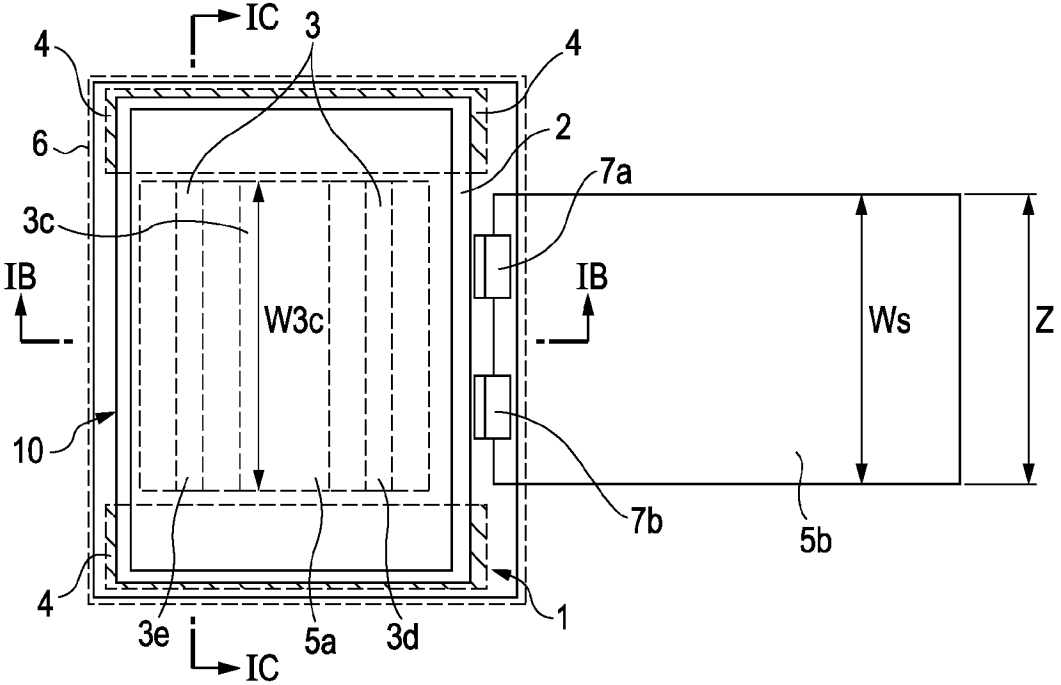
FIGS. 1A to 1C schematically show the structure of a recording apparatus according to an Embodiment 1 of the present invention.
Figure 1B:
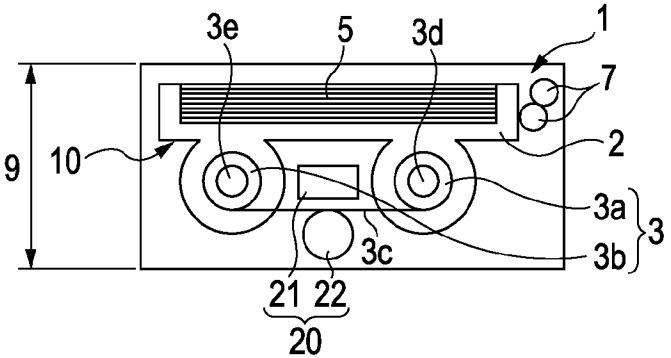
Figure 1C:
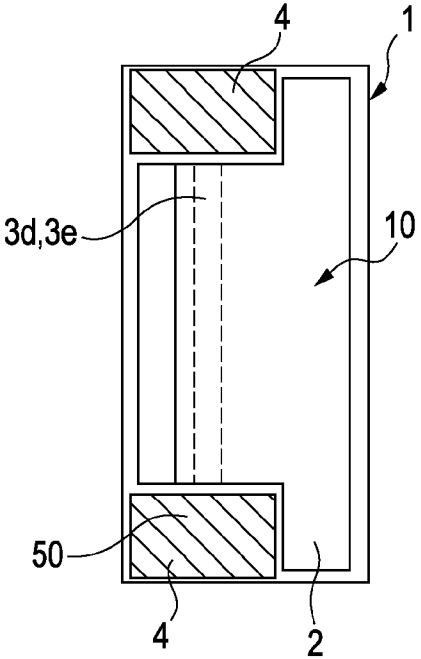

The embodiments of the present invention will now be described with reference to the drawings. In the figures, the same reference numerals will be used to designate the same or similar components. FIGS. 1A to 1C schematically show the structure of a recording apparatus according to an embodiment (Embodiment 1) of the present invention. FIG. 1A is a plan view. FIG. 1B is a sectional view taken along line IB-IB of FIG. 1A. FIG. 1C is a sectional view taken along line IC-IC of FIG. 1A. In FIGS. 1A to 1C, the recording apparatus is configured to be loaded with an integrated cartridge 10. The cartridge 10 contains recording sheets and an ink sheet. The cartridge 10 can be removed from the recording apparatus. The cartridge 10 has an integrated structure including a recording sheet container 2 and an ink sheet container 3. The ink sheet container 3 has a cartridge frame that holds a first bobbin 3*a* and a second bobbins 3*b* on which both ends of the ink ribbon are wound.

In FIGS. 1A to 1C, the area surrounded by a dashed line 6 designates the installation area of the recording apparatus. The direction of recording sheets 5*a* contained in the recording sheet container 2 is generally perpendicular to the direction of a recording sheet 5*b* being subjected to recording in the image forming section. In the shown example, the recording sheets 5*a* are contained in the cartridge 10 with their longitudinal direction (the direction of the long side) parallel to the direction of rotating shafts 3*d* and 3*e* of the bobbins 3*a* and 3*b* of the ink sheet (the longitudinal direction of the recording apparatus). The cartridge 10 is attached such that the direction in which the ink sheet is wound in the ink sheet container 3 corresponds to the direction in which the recording sheet 5 is conveyed (printing direction).

The width W3*c* of an ink sheet 3*c* is suitable to the length Ws of the short side of the recording sheet 5 for transferring the ink of the ink sheet 3*c* into the recording sheet 5. The length of the recording sheet container 2 in the direction of the rotating shaft 3*d* or 3*e* of the first bobbin 3*a* or the second bobbin 3*b* is larger than the rotating shaft 3*d* or 3*e*. That is to say, since the width of the ink sheet container 3 is smaller than the width of the recording sheet container 2. Therefore, spaces can be provided within the installation area 6 of the recording apparatus and under both sides of the recording sheet container 2. In this embodiment, spaces 4 are provided in the areas on both sides of the ink sheet container 3. The spaces 4 are provided in the direction of a normal line to the surface of the recording sheets contained in the recording sheet container 2, and in the direction of the rotating shafts 3*d* and 3*e* of the first bobbin 3*a* and the second bobbin 3*b*. In these spaces 4, "parts that cannot be disposed in an area Z through which a recording sheet passes during the printing, in terms of design" or "parts that can be but should not be disposed in the area Z" are disposed. For example, in these spaces 4, "parts that cannot be disposed in terms of design" including mechanical parts such as a gear driving a roller and stationary parts such as a shaft bearing, or "parts that should not be disposed" including electrical parts such as a motor, a power source board, and a control board, are disposed. Alternatively, a unit 50 for transmitting driving force to the rotating shaft 3*d* or 3*e* of the first bobbin 3*a* or the second bobbin 3*b*, or a driving unit 50 is disposed in the spaces 4.

The recording apparatus of FIGS. 1A to 1C is a thermal transfer recording apparatus that performs recording by heating an ink sheet and transferring ink onto a recording sheet. This thermal transfer recording apparatus is loaded with an integrated cartridge 10. The cartridge 10 is an integrated combination of a recording sheet container 2 and an ink ribbon container 3. The cartridge 10 can be removed. The recording sheet container 2 is a cassette in which a plurality of recording sheets can be loaded and from which one sheet can be pulled out at a time. The ink sheet container 3 has a structure such that both ends of a long ink sheet (ink ribbon) are fixed to two bobbins rotatably supported in a cartridge frame. By rotating one of the bobbins, the ink sheet can be pulled out along the surface of a recording sheet. That is to say, the ink sheet 3*c* wound on the first bobbin 3*a* is rewound by the second bobbin 3*b* that is driven.

The image forming section is provided with a line type thermal head 21 that has a plurality of heater elements arranged generally linearly in the width direction of the recording sheet. In the image forming section 20, the pulled out recording sheet and the ink sheet are pressed against each other between the recording head (thermal head) 21 and a platen roller 22. In synchronization with the paper feeding by the platen roller 22, the heater elements of the recording head 21 are driven, and the ink on the ink sheet is thereby melted and transferred onto the recording sheet. The image recording is thus performed.

Figure 2A:
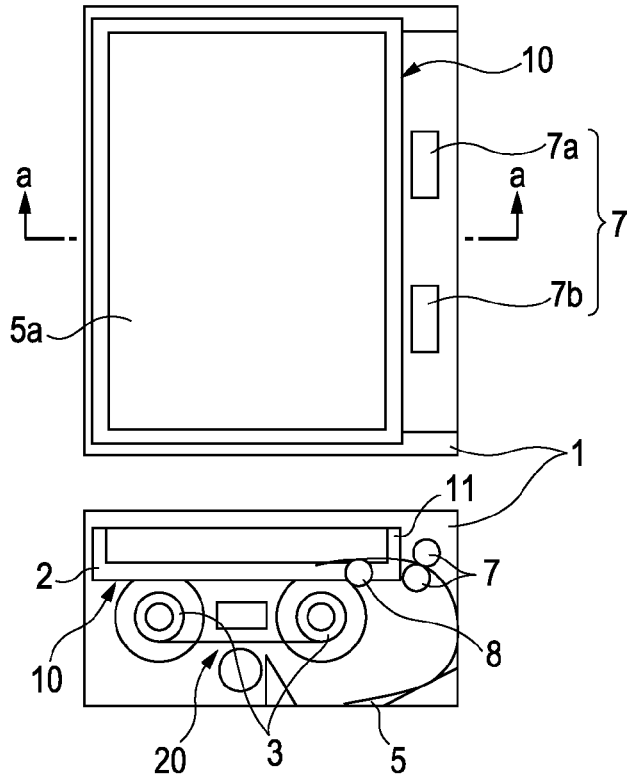
FIGS. 2A to 2C are plan views and sectional views schematically showing the structure of a recording apparatus according to Embodiment 1 of the present invention. A recording sheet is conveyed in the order of FIGS. 2A to 2C.
Figure 2B:
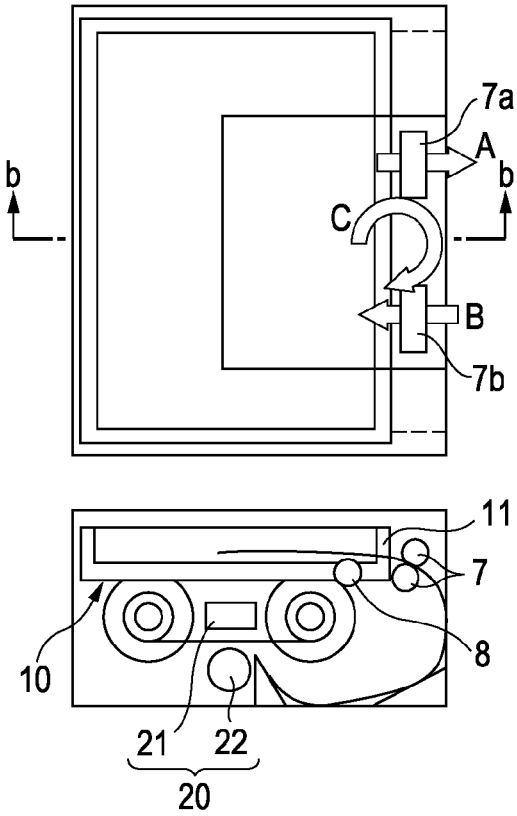
Figure 2C:
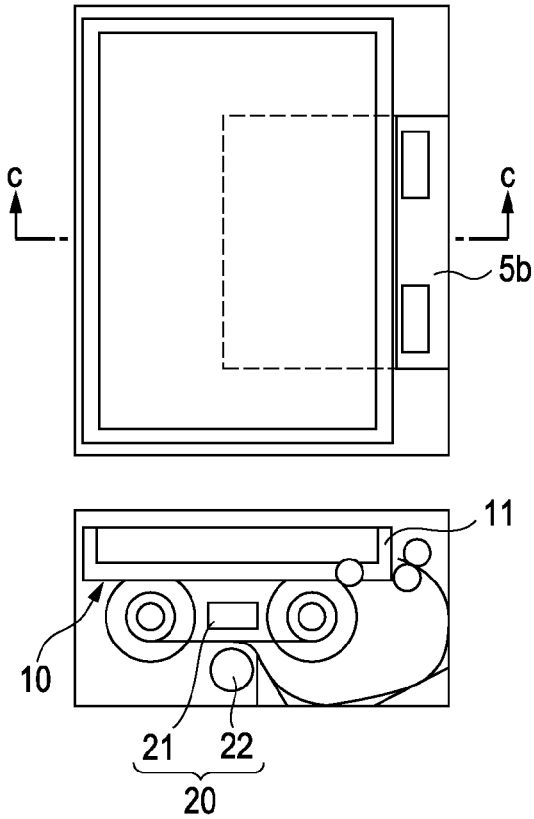

FIGS. 2A to 2C are plan views and sectional views schematically showing the structure of a recording apparatus according to Embodiment 1 of the present invention. A recording sheet is conveyed in the order of FIGS. 2A to 2C. FIG. 2A shows the state in which one of the recording sheets in the cartridge is separated and fed. FIG. 2B shows the state in which the fed recording sheet is turned. FIG. 2C shows the state in which the turned recording sheet is conveyed to the image forming section. In each of FIGS. 2A to 2C, the upper figure is a plan view, and the lower figure is a sectional view taken along line a-a, b-b, or c-c of the upper figure. The recording apparatus of FIGS. 2A to 2C has the same structure as the recording apparatus of FIGS. 1A to 1C. In the recording apparatus according to the this embodiment, as shown in FIGS. 2A to 2C, a paper feeding unit (a paper feeding roller 8) is disposed in the vicinity of the sheet outlet of the recording sheet container 2. This paper feeding unit includes separating pawls that can separate the loaded recording sheets. In this embodiment, the paper feeding roller 8 is disposed under the loaded sheets in the recording sheet container 2 so as to separate and feed (send out) only the lowermost one of the loaded sheets.

On the sheet outlet side of the recording sheet container 2, two pairs of nipping members 7*a* and 7*b* are disposed in the width direction at a predetermined interval. The two pairs of nipping members 7*a* and 7*b* can nip a recording sheet from both sides. In this embodiment, each of the two pairs of nipping members 7*a* and 7*b* is a pair of rollers consisting of a driving roller and a driven roller. By rotating the driving rollers (for example, the lower rollers) in the same direction, the two pairs of rollers 7*a* and 7*b* can convey a recording sheet in the anteroposterior direction. In addition, by rotating the driving rollers in the opposite direction from each other, the two pairs of rollers 7*a* and 7*b* can turn a recording sheet around an axis parallel to a normal line to the recording surface.

The two pairs of rollers 7*a* and 7*b* serve as a sheet turning unit that can turn a recording sheet 5 around an axis parallel to a normal line to the recording surface by approximately 90 degrees when the recording sheet 5 is fed to the image forming section 20 from the cartridge 10. That is to say, the recording apparatus according to this embodiment has a sheet turning unit for turning a recording sheet 5 around an axis parallel to a normal line to the recording surface when the recording sheet 5 is fed to the image forming section 20 from the cartridge 10. The direction of the long side of a recording sheet when contained in the recording sheet container 2 is generally perpendicular to the direction of the long side of the recording sheet when recording is performed in the image forming section 20. In this embodiment, the conveyance operation and turning operation are performed by two roller pairs disposed in the width direction. Alternatively, three or more roller pairs may be used for the conveyance operation and turning operation.

Next, the recording operation of the recording apparatus according to Embodiment 1 will be described using FIGS. 2A to 2C. The apparatus of FIGS. 2A to 2C has the same configuration as the apparatus of FIGS. 1A to 1C. The recording sheet is conveyed in the order of FIGS. 2A to 2C. FIG. 2A shows the state in which a recording sheets is pulled out (sent out). FIG. 2B shows the state in which the recording sheet is turned. FIG. 2C shows the state in which the recording sheet is conveyed to the image forming position (printing position). Referring to FIGS. 2A to 2C, the flow of conveyance of a recording sheet from the recording sheet container 2 to the image forming section 20 will hereinafter be described in detail.

FIG. 2A shows the separating and feeding operation, which is the first phase of the image forming operation of the recording apparatus. When a recording sheet 5 is separated and fed, the rollers of each roller pair may be pressed against each other or may be separated from each other because the two roller pairs 7*a* and 7*b* are not yet in contact with the recording sheet. In order to facilitate the conveyance of a recording sheet by the paper feeding roller 8, the recording sheets 5*a* in the recording sheet container 2 are pressed downward from above. The paper feeding roller 8 separates the lowermost sheet in the recording sheet container 2 and sends it to the sheet outlet 11 of the cartridge 10. The recording sheet is conveyed (fed) to the nips of the conveyance and turning roller pairs 7*a* and 7*b*. At this time, the conveyance and turning roller pairs 7*a* and 7*b* can be separated from each other (open) to reduce the resistance when the leading edge of the recording sheet enters.

Next, the recording sheet 5 is nipped by the conveyance and turning roller pairs 7*a* and 7*b*, and these roller pairs are rotated in the same direction. Thus, the recording sheet 5 is pulled out and up to the position of FIG. 2B. In the turning operation of the recording sheet shown in FIG. 2B, when part of the recording sheet is still in the recording sheet container 2, the recording sheet is turned by rotating the two roller pairs 7*a* and 7*b* in the opposite direction from each other.

At this time, the roller pairs 7*a* and 7*b* are rotated in the opposite direction from each other, and the recording sheet is turned in the direction of arrow C by approximately 90 degrees. Any turning angle can be set. In this embodiment, the turning angle is set to about 90 degrees because the recording sheet needs to be turned from the position when it is in the container to the position when it is subjected to printing. At this time, in order to generate a force couple on the right and left sides of the recording sheet 5, each of the conveyance and turning roller pairs 7*a* and 7*b* nips the recording sheet 5 from both sides. At the time of the turning operation, the paper feeding roller 8 and the recording sheet container 2 may be in any state. However, since part of the recording sheet 5 is in the recording sheet container 2, the paper feeding roller 8 is can be separated from the recording sheet 5 in order to release the recording sheet 5 from the pressure.

In addition, at the time of the turning operation, in order to prevent the walls and parts of the cartridge 10 from obstructing the recording sheet, slits or guides can be provided in such places. Moreover, in order to prevent the recording sheet from being obstructed when it is turned, the distance of movement from the position of separation to the position of turning operation, that is to say, the distance by which the recording sheet is pulled out, can be appropriately set or adjusted.

After the recording sheet is turned by about 90 degrees, the conveyance and turning roller pairs 7*a* and 7*b* are rotated in the same direction, thereby conveying the recording sheet to the image forming position shown in FIG. 2C. In this embodiment, the recording sheet 5 is conveyed to the image forming section 20 located under the cartridge 10. At this time, the conveyance and turning roller pairs 7*a* and 7*b* nip the recording sheet. By rotating the driving rollers of the two roller pairs 7*a* and 7*b* in the same direction, the recording sheet is conveyed. In this way, the recording sheet is conveyed to the image forming section 20. In the image forming section 20, the recording sheet is nipped between the recording head 21 and the platen roller 22, together with the ink sheet pulled out from the ink sheet container 3. The platen roller 22 rotates to feed the recording sheet in the direction of the long side of the recording sheet 5, and the recording head 21 generates heat to transfer ink. In this way, an image is recorded on the recording sheet. The width W3*c* of the ink sheet 3*c* is generally equivalent to the length Ws of the short side of the recording sheet 5. In more detail, the width W3*c* of the ink sheet 3*c* is a little larger than the length Ws of the short side of the recording sheet 5.

Figure 7A:
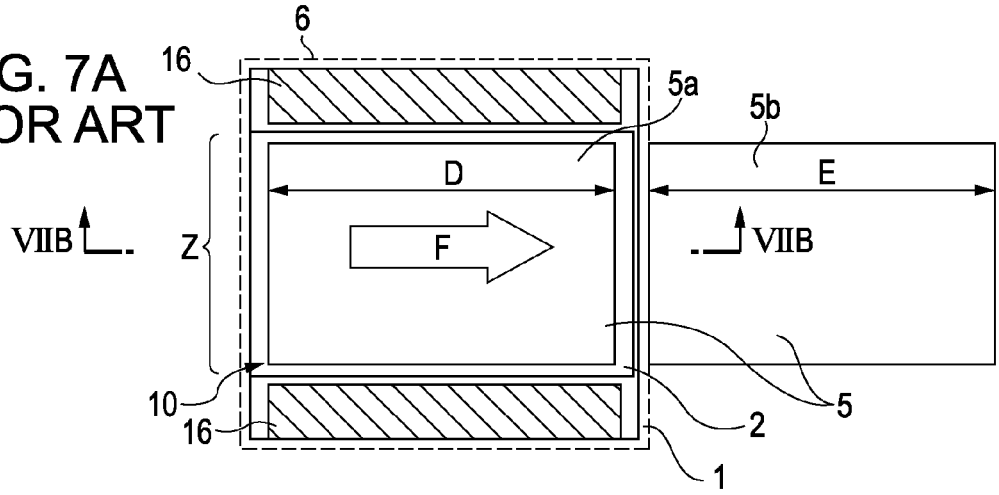
FIG. 7A PRIOR ART
FIGS. 7A and 7B show a recording apparatus configured to convey recording sheets contained in an integrated cartridge attached to an apparatus body, in their longitudinal direction.
Figure 7B:
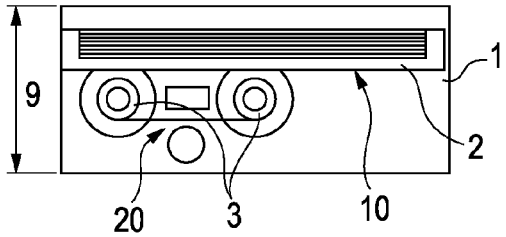
FIG. 7B PRIOR ART
Figure 8A:
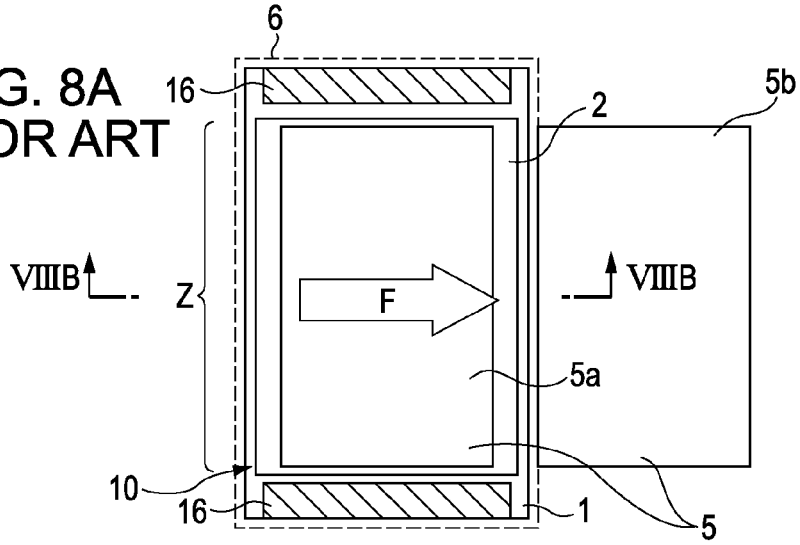
FIG. 8A PRIOR ART
FIGS. 8A and 8B show a recording apparatus configured to convey recording sheets contained in an integrated cartridge attached to an apparatus body, in their width direction (in a direction parallel to the short side).
Figure 8B:
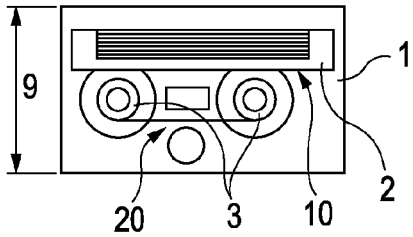
FIG. 8B PRIOR ART

In the configuration of FIGS. 1A to 1C and 2A to 2C, "parts that cannot be disposed in an area Z through which a recording sheet passes during the printing, in terms of design" or "parts that can be but should not be disposed in the area Z," which have been described with reference to FIGS. 7A and 7B, can be disposed within the area of the recording sheet container (cassette) 2. Therefore, the installation area 6 of the recording apparatus can be close to the area of the recording sheet container 2.

As methods for turning the recording sheet, various methods have been proposed. The sheet turning unit using two roller pairs that has been described with reference to FIG. 2B is one such example. A mechanism for rotating a recording sheet using two roller pairs is disclosed in, for example, Japanese Patent Laid-Open No. 5-213487. As an example of mechanisms for rotating a recording sheet pulled out from a recording sheet container, in this embodiment, a mechanism using two roller pairs 7*a* and 7*b* has been described. The present invention may be carried out using mechanisms having other configurations. Also in that case, the same working-effect can be achieved.

Figure 4A:
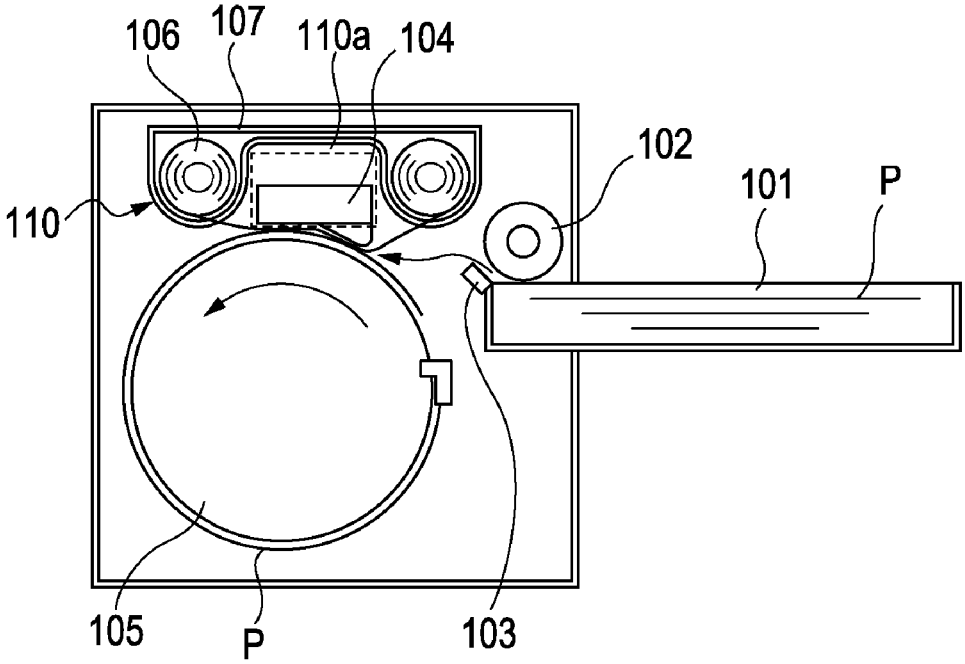
FIG. 4A PRIOR ART
FIGS. 4A and 4B are sectional views of a first example of a conventional thermal transfer recording apparatus.
Figure 4B:
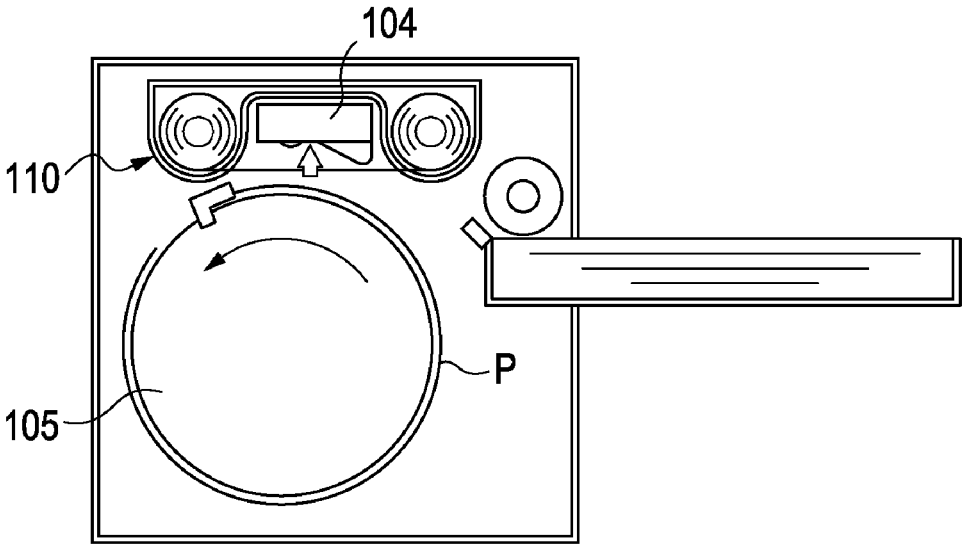
FIG. 4B PRIOR ART
Figure 5A:
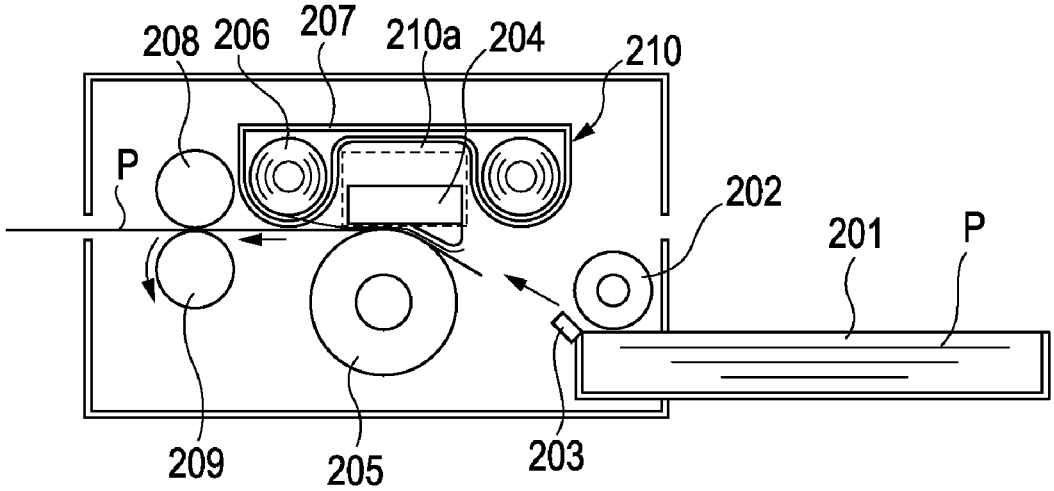
FIG. 5A PRIOR ART
FIGS. 5A and 5B are sectional views of a second example of a conventional thermal transfer recording apparatus.
Figure 5B:
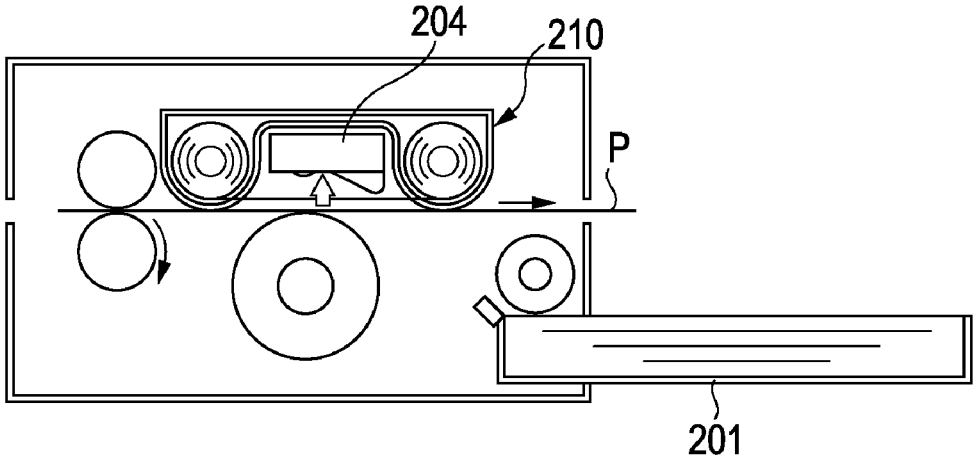
FIG. 5B PRIOR ART
Figure 6A:
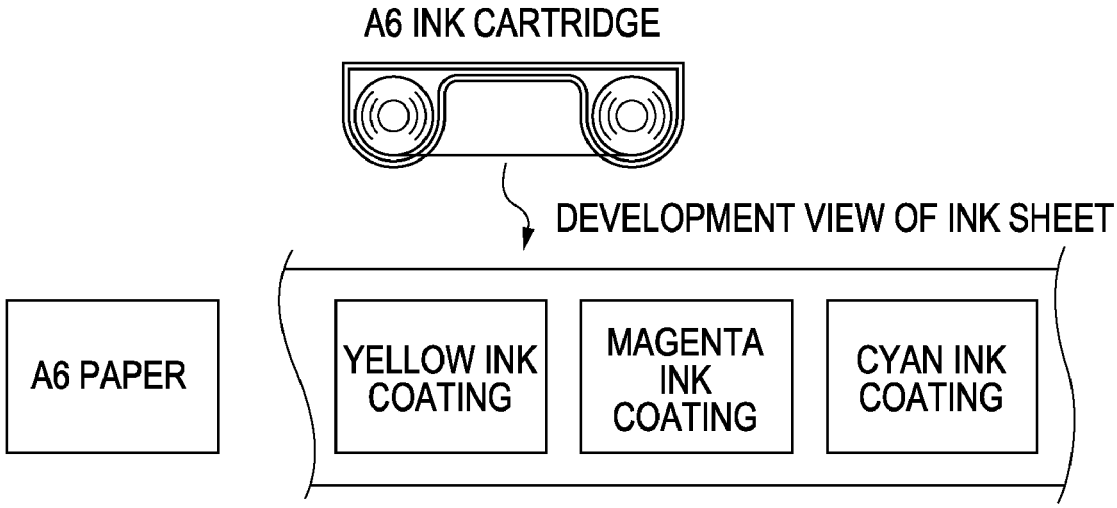
FIG. 6A PRIOR ART
FIGS. 6A and 6B each schematically show an example of a set with a cartridge and recording sheets.
Figure 6B:
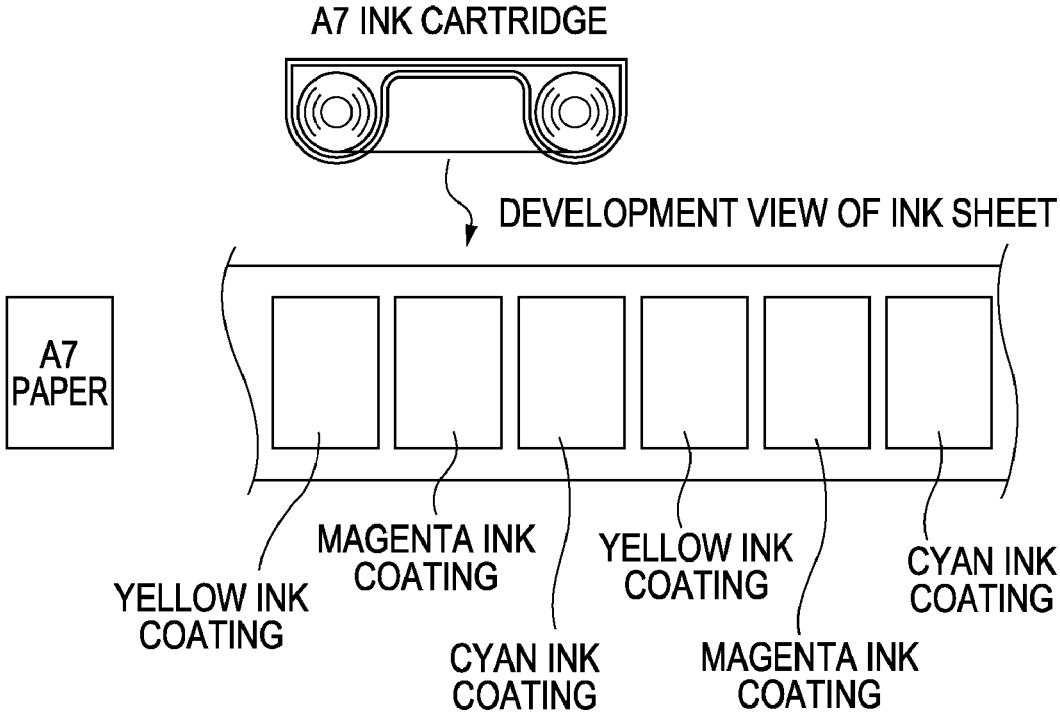
FIG. 6B PRIOR ART

The above-described configuration and operation for turning a recording sheet pulled out from the integrated cartridge 10 can also be applied to the image forming apparatus shown in FIGS. 4A and 4B that performs recording (transferring) on a recording sheet wound around a platen roller 105. The configuration for turning a recording sheet can also be applied to the image forming apparatus shown in FIGS. 5A and 5B that uses a platen roller 205 and a capstan roller 209. Also in that case, the same working-effect can be achieved.

Embodiment 2

Figure 3A:
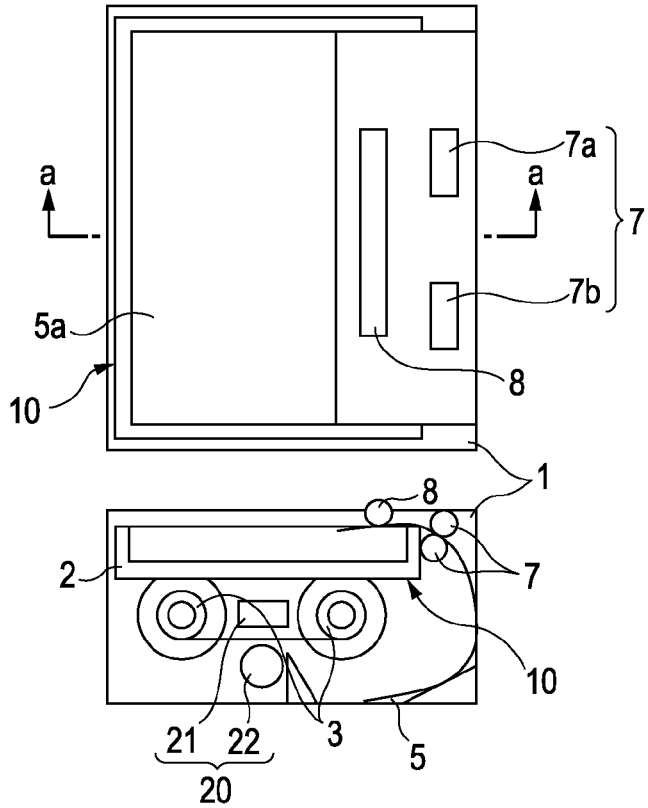
FIGS. 3A to 3C are plan views and sectional views schematically showing the structure of a recording apparatus according to an Embodiment 2 of the present invention. A recording sheet is conveyed in the order of FIGS. 3A to 3C.
Figure 3B:
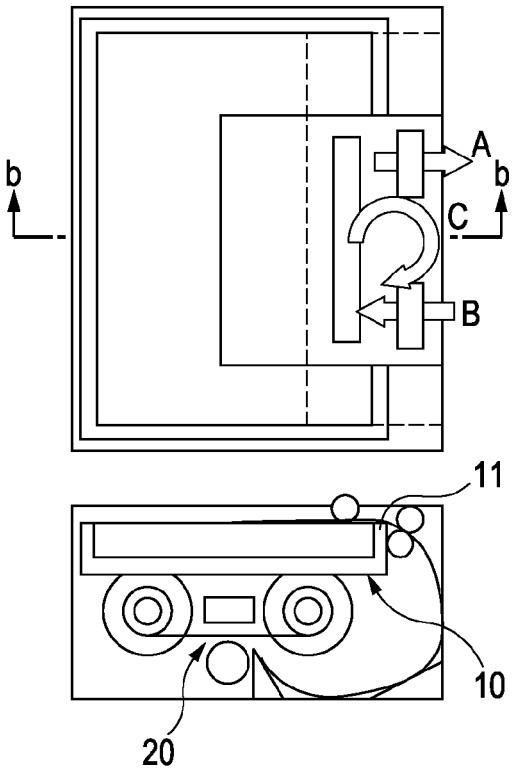
Figure 3C:
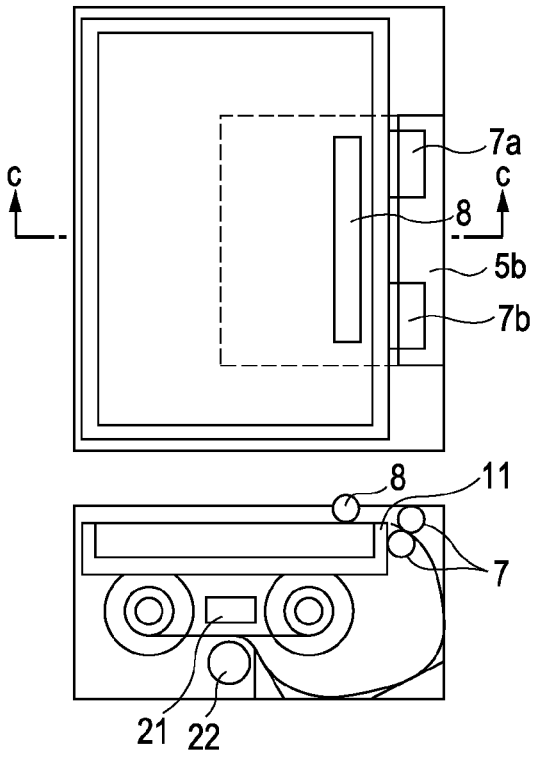

FIGS. 3A to 3C are plan views and sectional views schematically showing the structure of a recording apparatus according to Embodiment 2 of the present invention. A recording sheet is conveyed in the order of FIGS. 3A to 3C. FIG. 3A shows the state in which one of the recording sheets in the cartridge is separated and fed. FIG. 3B shows the state in which the fed recording sheet is turned. FIG. 3C shows the state in which the turned recording sheet is conveyed to the image forming section. In each of FIGS. 3A to 3C, the upper figure is a plan view, and the lower figure is a sectional view taken along line a-a, b-b, or c-c of the upper figure. This embodiment differs from Embodiment 1 in the following three points. For the rest, this embodiment has generally the same configuration as the case of FIGS. 1A to 1C and 2A to 2C and operates similarly. That is to say, first, the sheet outlet 11 of the recording sheet container 2 is provided in the upper part of the recording sheet container 2. Second, since the sheet outlet 11 is provided in the upper part of the recording sheet container 2, the conveyance and turning roller pairs 7*a* and 7*b* are located slightly higher than those in Embodiment 1. Third, since the sheet outlet 11 is provided in the upper part of the recording sheet container 2, the paper feeding roller 8 is disposed above the loaded sheets so as to feed the sheets from the uppermost sheet, one at a time.

FIGS. 3A to 3C show the flow of conveyance of a recording sheet. FIG. 3A shows the state in which a recording sheet is pulled out (sent out). FIG. 3B shows the state in which the recording sheet is turned. FIG. 3C shows the state in which the recording sheet is conveyed to the image forming position (printing position). Using FIGS. 3A to 3C, the flow of conveyance of a recording sheet from the recording sheet container 2 to the image forming section 20 will hereinafter be described. In this embodiment, since the sheet outlet 11 is provided in the upper part of the recording sheet container 2 of the cartridge 10, the conveyance and turning roller pairs 7*a* and 7*b* are located higher than those in Embodiment 1, and accordingly the conveyance path is slightly longer than that in Embodiment 1.

The flow of operation of separating a recording sheet in the recording sheet container 2 and conveying it to the image forming section 20 is generally the same as that in Embodiment 1. That is to say, in the separating phase of FIG. 3A, the conveyance and turning roller pairs 7*a* and 7*b* are open, and a recording sheet is separated by the paper feeding roller 8 and sent out from the sheet outlet 11. After the recording sheet is conveyed to the conveyance and turning roller pairs 7*a* and 7*b*, the conveyance and turning roller pairs 7*a* and 7*b* nip the recording sheet. By rotating the roller pairs in the same direction, the recording sheet is pulled out and up to the turning position shown in FIG. 3B. In nipping the recording sheet, the conveyance and turning roller pairs 7*a* and 7*b* are rotated in the opposite direction from each other. By a force couple shown by arrows A and B, the recording sheet is turned in the direction of arrow C. Also in this embodiment, since the recording sheet is turned from the position when it is in the container to the position when it is subjected to printing, the turning angle in the direction of arrow C is set to about 90 degrees.

After the recording sheet is turned by about 90 degrees, the conveyance and turning roller pairs 7*a* and 7*b* still nip the recording sheet and are rotated in the same direction, thereby conveying the recording sheet to the image forming position 20 as shown in FIG. 3C. In the image forming section, the recording sheet is nipped between the recording head 21 and the platen roller 22, together with the ink sheet pulled out from the ink sheet container 3. The platen roller 22 rotates to feed the recording sheet, and the recording head 21 generates heat to transfer ink. In this way, an image is recorded on the recording sheet.

Also in the configuration of FIGS. 3A to 3C, "parts that cannot be disposed in an area Z through which a recording sheet passes during the printing, in terms of design" or "parts that can be but should not be disposed in the area Z," which have been described with reference to FIGS. 7A and 7B, can be disposed within the area of the recording sheet container 2. Therefore, the installation area 6 of the recording apparatus can be close to the area of the recording sheet container 2. In addition, also in this embodiment, the method for turning a recording sheet is not limited to the method in which two roller pairs are rotated in the opposite direction from each other, and various methods can be used.

The configuration and operation for turning a recording sheet pulled out from the integrated cartridge 10 in this embodiment can also be applied to the image forming apparatus shown in FIGS. 4A and 4B that performs multicolor printing using a platen roller 105 that rotates in only one direction. They can also be applied to the image forming apparatus shown in FIGS. 5A and 5B that performs multicolor printing using a platen roller 205 and a capstan roller 209 that move a recording sheet back and force.

In the case of the recording apparatuses of the above embodiments, "parts that cannot be disposed in an area through which a recording sheet passes during the printing" or "parts that should not be disposed in the area" can be disposed within the area of the recording sheet container (cassette) 2. As a result, the installation area of the recording apparatuses of the above embodiments can be close to the area of the recording sheet container. Therefore, the recording apparatuses of the above embodiments can be as simple and compact as a conventional recording apparatus into which an ink sheet and recording sheets are separately loaded, and can be loaded with an integrated cartridge containing an ink sheet and recording sheets.

In the case of the integrated cartridge of the above embodiments, printing operation can be started without taking out the ink sheet from the cartridge and loading it to the printing position. A user need not separately load the ink sheet and the recording sheets into the recording apparatus. In addition, when using another type of recording sheets, a user need not separately keep the unloaded ink sheet and recording sheets. Thus, a recording apparatus having a high degree of usability can be obtained.

In the above embodiments, a thermal transfer recording apparatus that transfers ink from an ink sheet to a recording sheet using a thermal head, is taken as an example. The present invention can also be applied to other types of recording apparatuses, as long as the apparatuses can be loaded with a cartridge including a recording sheet container. Also in that case, the same working-effect can be achieved. In addition, in the above embodiments, a line type recording apparatus that performs recording using a line head extending in the width direction of a recording sheet and using only the sub-scanning in the conveyance direction, is taken as an example. The present invention can also be applied to a serial type recording apparatus that performs recording using a recording head that is mounted on a carriage and reciprocates in the width direction of a recording sheet. Also in that case, the same working-effect can be achieved.

Moreover, the present invention can be applied not only to a recording apparatus using a single recording head but also to a recording apparatus using a plurality of recording heads using a plurality of inks, for example, inks of different colors, or inks of the same color but different densities. Furthermore, the present invention can also be applied to a recording apparatus that combines these. Also in that case, the same working-effect can be achieved. In addition, the present invention can be widely applied to apparatuses that function as a recording apparatus, for example, a printer, a photocopier, a scanner, a complex machine of these, and a recording apparatus in a system. Also in that case, the same working-effect can be achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-229769 filed Aug. 8, 2005, which is hereby incorporated by reference herein in its entirety.

What is claimed is:

1. An integrated cartridge configured to contain recording sheets and be detachably mountable in a main body of a recording apparatus, the integrated cartridge comprising:

a recording sheet container having a recording sheet container compartment that is configured to contain the recording sheets; and an ink sheet container integrated with the recording sheet container, wherein the ink sheet container includes an ink sheet having ink, an ink cartridge frame, a first bobbin supported to the ink cartridge frame, and a second bobbin supported to the ink cartridge frame, wherein the ink sheet is wound about the first bobbin and the second bobbin is configured to rotate to pull the ink sheet from the first bobbin, wherein the first bobbin and the second bobbin are spaced apart to allow ink from that portion of the ink sheet residing between the first bobbin and the second bobbin to be transferred onto a recording sheet conveyed from the recording sheet container and positioned between the first bobbin and the second bobbin in an image forming section, wherein the recording sheets are contained in the recording sheet container so that an orientation of recording sheets in the recording sheet container is generally perpendicular to an orientation of a recording sheet positioned in the image forming section, wherein the recording sheets is turned around an axis parallel to a normal line to the recording surface of the recording sheet when being conveyed from the recording sheet container to the image forming section, wherein the ink sheet container includes a length and a width, wherein the width of the ink sheet container is measured parallel to the first bobbin axis, wherein the recording sheet container includes a length and a width, wherein the width of the recording sheet container is measured parallel to the first bobbin, and wherein the width of the ink sheet container is smaller than the width of the recording sheet container.

2. The integrated cartridge of claim 1, where each recording sheet has a short side and a long side, wherein a length of the long side is greater than a length of the short side.

3. The integrated cartridge of claim 2, wherein the first bobbin includes a first bobbin axis passing through a center around which the first bobbin is configured to rotate and the second bobbin includes a second bobbin axis passing through a center around which the second bobbin is configured to rotate to pull the ink sheet from the first bobbin and receive the ink sheet as the wound ink sheet roll, wherein the recording sheet container compartment is configured to contain the recording sheets so that the long side of recording sheets positioned within the recording sheet container compartment is parallel to both the first bobbin axis and the second bobbin axis, and wherein the second bobbin is configured to pull the ink sheet in a direction that is parallel to the long side of a recording sheet positioned in the image forming section.

4. The integrated cartridge of claim 3, wherein the ink sheet includes an ink sheet width that is perpendicular to the direction, and wherein the ink sheet width is suitable to the length of the short side of a recording sheet for transferring ink of the ink sheet into a recording sheet.

5. The integrated cartridge of claim 4, wherein the ink sheet width is greater than the length of the short side of each recording sheet so as to be suitable to the length of the short side of a recording sheet for transferring ink of the ink sheet into a recording sheet.

6. The integrated cartridge of claim 1, wherein the width of the ink sheet container is greater than the length of the ink sheet container and the width of the recording sheet container is greater than the length of the recording sheet container.

7. A recording apparatus, comprising:

a main body; and an integrated cartridge configured to contain recording sheets and be detachably mountable in the main body, wherein the integrated cartridge includes:

a recording sheet container having a recording sheet container compartment that is configured to contain the recording sheets, and an ink sheet container integrated with the recording sheet container, wherein the ink sheet container includes an ink sheet having ink, an ink cartridge frame, a first bobbin supported to the ink cartridge frame, and a second bobbin supported to the ink cartridge frame, wherein the ink sheet is wound about the first bobbin and the second bobbin is configured to rotate to pull the ink sheet from the first bobbin, wherein the first bobbin and the second bobbin are spaced apart to allow ink from that portion of the ink sheet residing between the first bobbin and the second bobbin to be transferred onto a recording sheet positioned between the first bobbin and the second bobbin in an image forming section, a sheet turning unit configured to turn the recording sheet around an axis parallel to a normal line to a recording surface of the recording sheet when the recording sheet is conveyed from the cartridge to the image forming section, wherein the recording sheets are contained in the recording sheet container so that an orientation of recording sheets in the recording sheet container is generally perpendicular to an orientation of a recording sheet positioned in the image forming section, wherein the ink sheet container includes a length and a width, wherein the width of the ink sheet container is measured parallel to the first bobbin axis, wherein the recording sheet container includes a length and a width, wherein the width of the recording sheet container is measured parallel to the first bobbin, and wherein the width of the ink sheet container is smaller than the width of the recording sheet container.

8. The recording apparatus of claim 7, further comprising:

parts, wherein the parts are at least one of parts that cannot be disposed in an area Z through which a recording sheet passes during printing, in terms of design, and parts that can be but should not be disposed in the area Z, wherein the parts are disposed in spaces provided within an installation area and under two sides of the recording sheet container.

9. The recording apparatus of claim 8, wherein the spaces are provided in areas on both sides of the ink sheet container in a direction of a line normal to a surface of the recording sheets contained in the recording sheet container compartment and in a direction of the first bobbin axis and the second bobbin axis.

10. The recording apparatus of claim 7, wherein the recording apparatus is a thermal transfer recording apparatus configured to perform recording by heating the ink sheet and transferring ink onto a recording sheet.

11. The recording apparatus of claim 7, wherein a recording sheet positioned in the image forming section has a width as measured parallel to the first bobbin, the recording apparatus further comprising:

a line type thermal head having a plurality of heater elements arranged generally linearly in a direction of the width of the recording sheet; and a platen roller configured to cooperate with the line type thermal head to transfer ink onto the recording sheets.

12. The recording apparatus of claim 7, further comprising:

a paper feeding unit configured to separate a recording sheet from the recording sheets in the recording sheet container compartment and to feed the separated recording sheet downstream;

a sheet turning unit configured to turn the separated recording sheet from a first orientation to a second orientation that is generally perpendicular to the first orientation; and a conveying unit configured to convey the turned recording sheet to the image forming section.

13. The recording apparatus of claim 12, wherein the paper feeding unit is disposed in a vicinity of a sheet outlet of the recording sheet container and under recording sheets loaded in the recording sheet container compartment to separate and feed only a lowermost recording sheet from the loaded recording sheets.

14. The recording apparatus of claim 12, wherein the sheet turning unit includes nipping members configured to nip a recording sheet from at least two sides.

15. The recording apparatus of claim 14, wherein each nipping member includes a driving roller and a driven roller such that rotating the driving rollers in the opposite direction from each other while a recording sheet resides within the nipping members results in turning a recording sheet around an axis perpendicular to a recording surface of the recording sheet.

16. The recording apparatus of claim 14, wherein the nipping members include three or more nipping members.

17. The recording apparatus of claim 12, wherein the paper feeding unit is disposed in a vicinity of a sheet outlet of the recording sheet container and above recording sheets loaded in the recording sheet container compartment to separate and feed only an uppermost recording sheet from the loaded recording sheets.

18. One of a printer, a photocopier, and a scanner, comprising:

the recording apparatus of claim 7.

* * * * *